US006058843A

United States Patent [19]

Young

[11] Patent Number: 6,058,843

[45] **Date of Patent: *May 9, 2000**

[54] MACHINE AND METHOD FOR PRINTING ON SURFACES OF EDIBLE SUBSTRATES

[75] Inventor: Robert John Young, Orpington, United Kingdom

[73] Assignee: Cadex Limited, London, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/930,485

[22] PCT Filed: Feb. 2, 1996

[86] PCT No.: PCT/GB96/00229

§ 371 Date: Sep. 30, 1997

§ 102(e) Date: Sep. 30, 1997

[87] PCT Pub. No.: WO97/27759

PCT Pub. Date: Aug. 7, 1997

[30] Foreign Application Priority Data

Jul. 29, 1994 [GB] United Kingdom ..... 9415333

[51] Int. Cl.[7] ..... B41J 2/175

[52] U.S. Cl. ..... 101/483; 347/4; 347/5; 347/106; 347/107; 118/14; 364/479.14

[58] Field of Search ..... 101/488, 491, 101/483; 400/76, 120.01, 120.02, 120.16, 120.17; 347/2, 4, 5, 3, 43, 106, 107, 100; 118/13, 14, 16; 358/298; 364/479.14

[56] References Cited

U.S. PATENT DOCUMENTS

| | | | |
|---|---|---|---|
| 4,168,662 | 9/1979 | Fell | 101/491 |
| 4,585,484 | 4/1986 | Haruta et al. . | |
| 4,910,661 | 3/1990 | Barth et al. | 364/167.01 |
| 4,920,422 | 4/1990 | Lapierre | 347/2 |
| 4,930,018 | 5/1990 | Chan et al. | 347/43 |
| 4,940,998 | 7/1990 | Asakawa | 347/43 |
| 5,012,257 | 4/1991 | Lowe et al. | 347/43 |
| 5,021,802 | 6/1991 | Allred | 347/99 |
| 5,031,050 | 7/1991 | Chan | 358/298 |
| 5,118,351 | 6/1992 | Shirota et al. . | |
| 5,397,387 | 3/1995 | Deng et al. . | |
| 5,453,121 | 9/1995 | Nicholls et al. . | |
| 5,463,412 | 10/1995 | Matsuda | 347/43 |
| 5,487,614 | 1/1996 | Hale | 347/43 |
| 5,500,662 | 3/1996 | Watanabe | 347/43 |
| 5,505,775 | 4/1996 | Kitos | 118/14 |
| 5,543,177 | 8/1996 | Morrison et al. | 347/100 |

FOREIGN PATENT DOCUMENTS

| | | |
|---|---|---|
| 0348 181 | 12/1989 | European Pat. Off. . |
| WO 92/14795 | 9/1992 | WIPO . |
| WO 96/02598 | 2/1996 | WIPO . |

*Primary Examiner*—Eugene Eickholt
*Attorney, Agent, or Firm*—Townsend and Townsend and Crew LLP

[57] ABSTRACT

A machine adapted to print an image as hereinbefore defined onto a surface of an edible substrate, the machine including a bubble-jet printer head assembly, and including a container for containing a liquid food colorant, a surface for supporting the said edible substrate, said surface and said head assembly being movable relative to each other, and a controller for controlling the said head assembly with printing instructions and for causing said relative movement in accordance with the desired image to be printed upon a edible substrate. This invention also included a method of printing an image onto an edible substrate.

12 Claims, 3 Drawing Sheets

MACHINE AND METHOD FOR PRINTING ON SURFACES OF EDIBLE SUBSTRATES

The term "image" as used throughout the specification and claims refers to any polychromatic or monochromatic design, picture, text or pattern which is required to be reproduced by the invention.

SUMMARY OF THE INVENTION

It is an object of the present invention to alleviate the problems and difficulties of known methods and apparatus for the decoration of cakes, etc.

According to a first aspect of the present invention there is provided a machine adapted to print an image as hereinbefore defined onto a surface of an edible substrate, the machine including a bubble-jet printer head assembly, and including containment means for containing a liquid food colourant, a surface for supporting the said edible substrate, said surface and said head assembly being movable relative to each other, and control means for controlling the said head assembly and for causing said relative movement in accordance with the desired image to be printed upon a edible substrate.

According to a second aspect of the present invention there is provided a method of printing an image on a surface of an edible substrate which method comprises arranging for relative movement between said surface and a bubble-jet printer head assembly and controlling said print head assembly to cause a liquid food colourant to be printed upon the substrate in accordance with the desired image.

Preferably the bubble-jet printer head assembly is of the type produced by Canon Inc under European Patent Number EP 0 348 181 A2.

In a preferred method and machine of this invention, the printer head comprises a discharge opening for liquid discharge and an electricity-heat converter. The electricity-heat converter has a region formed by oxidation of at least part of an electro-conductive material, and the region is adapted to generate heat.

Preferably the machine of the present invention includes a computer system to store and manipulate the image. Preferably the machine of the present invention includes within such a computer system encryption means which can only be accessed by a purchaser if they first obtain from the supplier the decryption code to unscramble the image. This feature enables copyrighted images to be offered to the purchaser whilst still being able to guarantee the copyright holder his rightful royalties based on the number of times the purchaser utilises the image.

Preferably the machine of the present invention is capable of printing on both regular and irregular substrates. Furthermore it is preferred that the machine be adapted to print on surfaces having a degree of three dimensionality.

DETAILED DESCRIPTION OF A PREFERRED EMBODIMENT

Figure 1:
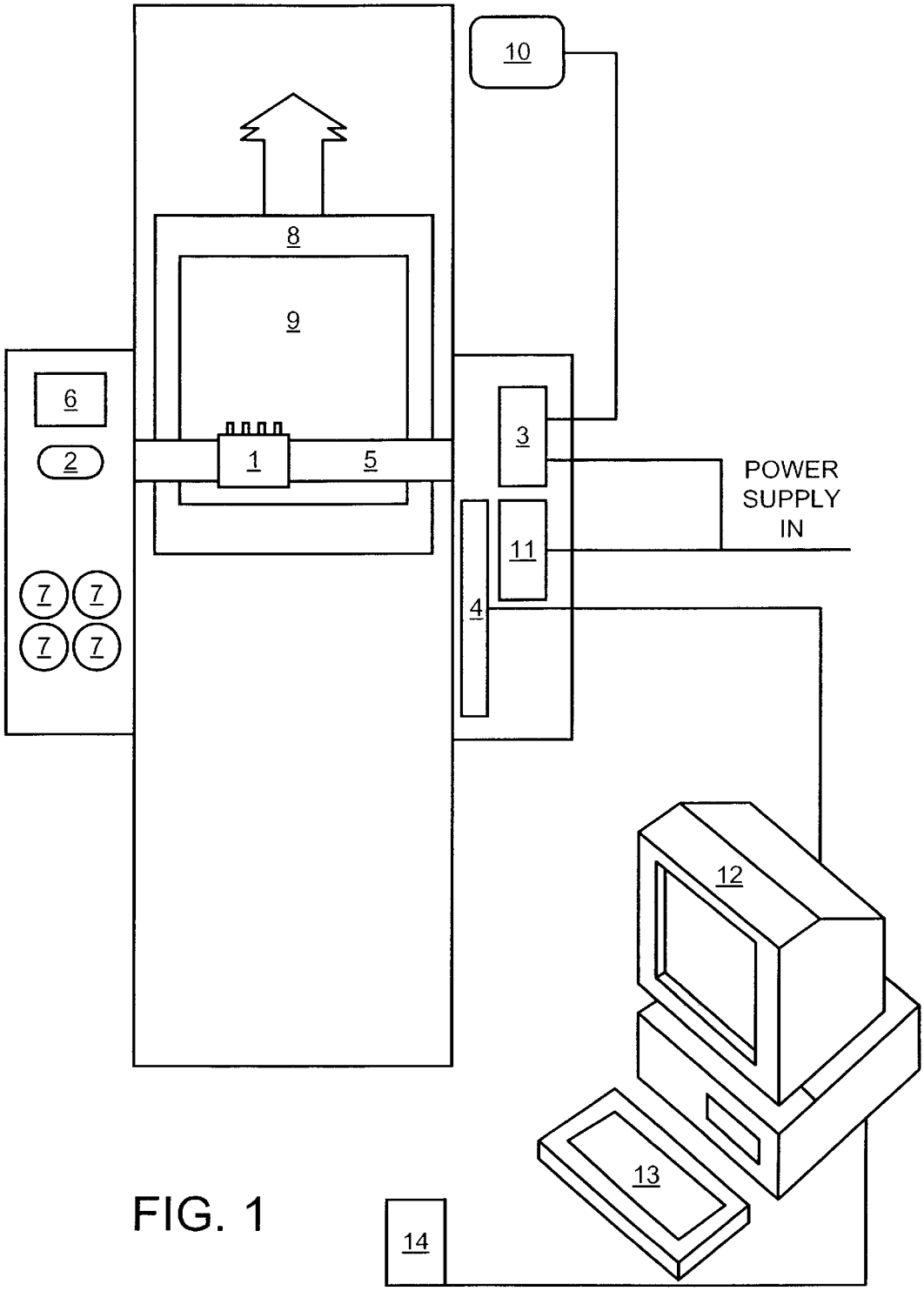
Figure 2:
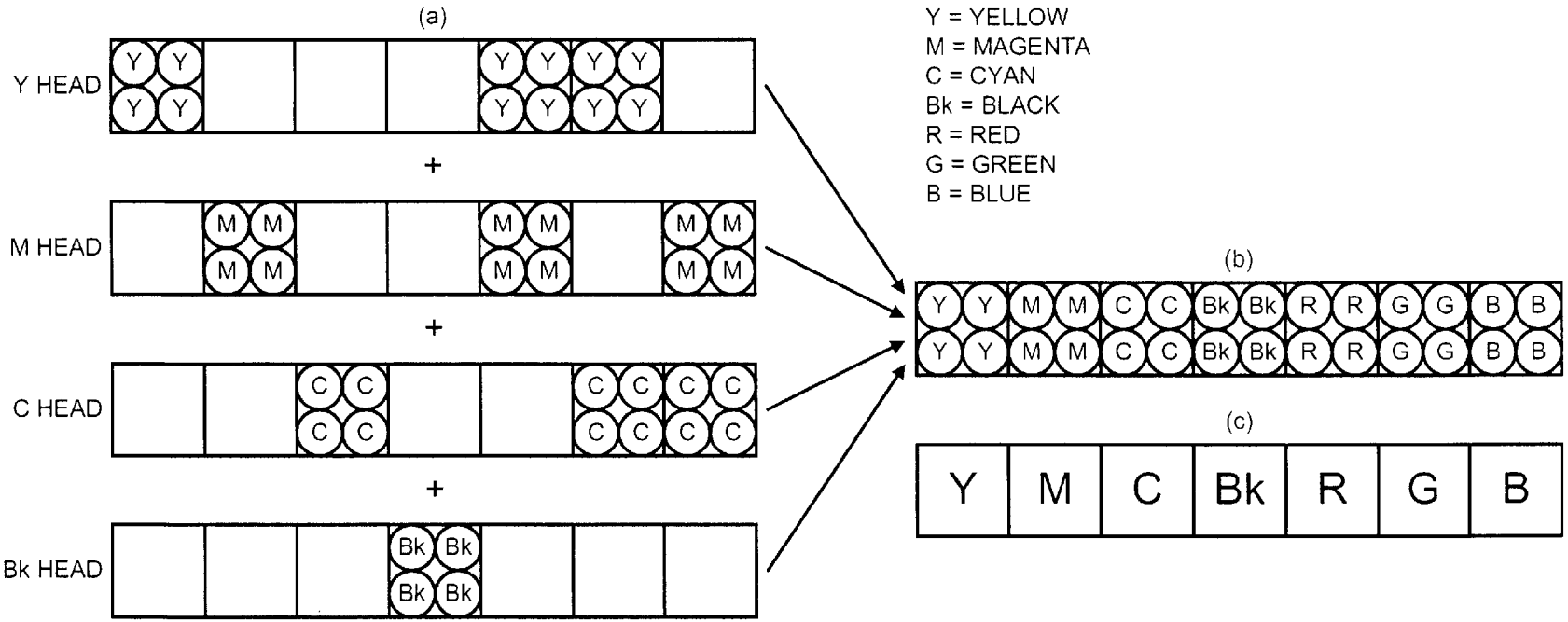
Figure 3:
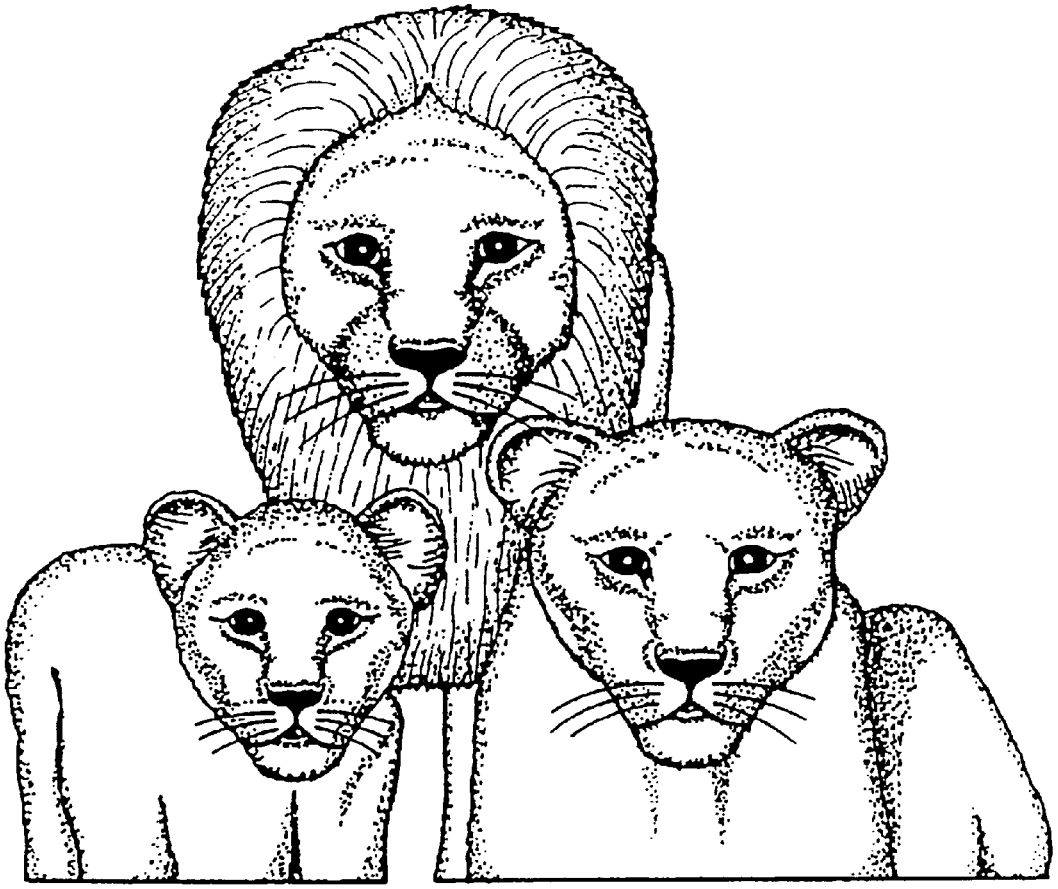

An embodiment of a machine according to the present invention will now be described, by way of example only, by reference to the accompanying drawings in which;

FIG. 1 is a diagrammatic representation of an embodiment of a machine according to the present invention;

FIGS. 2(*a*), 2(*b*) and 2(*c*) are diagrammatic representations of a method of obtaining polychromatic output from the machine of FIG. 1; and FIG. 3 is an example of the output of the machine of FIG. 1 showing detail that would not otherwise be possible by any other method.

Referring to FIG. 1 of the drawings there is shown a bubble-jet head assembly (1) together with a stepping motor (2) for moving the head assembly (1). The stepping motor (2) is connected to a power supply (11). A logic board (4) controls the movement of the bubble-jet head assembly (1) via the stepping motor (2) across a carriageway (5). A pump (6) is provided to clean the bubble-jet head assembly (1) and deliver the liquid food colour to the bubble-jet head assembly (1) from ink reservoirs (7). A movable surface (8) is provided to support an edible medium (9); a stepping motor (10) is connected to a dedicated power supply (3) and to a logic board (4) to advance the movable surface (8). The required image is stored on magnetic media held within a computer (12) and is accessed by entering the required image code via a keyboard, keypad or pointing device (13). If the image is copyrighted it will be protected by an encryption algorithm and may only be decrypted by means of a card reader (14). The image once selected is sent to the bubble-jet head assembly (1) via the logic board (4) e.g. as a bitmap, raster image, postscript or pcx file etc., which will cause the bubble-jet head assembly (1) to move across the carriageway (5) by use of the stepping motor (2) and will then deposit colourant taken from the reservoirs (7) at predetermined positions across the top of the edible medium. As the bubble-jet print head assembly (1) reaches the end of the carriageway (5) the stepping motor (10) will advance the edible medium (9) by moving the movable surface (8) a predetermined distance, e.g. ¼ inch. The bubble-jet head assembly (1) will then print in the opposite direction along the carriageway (5) until it reaches its starting position. The machine will continue the above operations until the required picture, pattern or text has been completed. By this method virtually unskilled operatives can produce decorated cakes or cake tops to a high resolution and a multiplicity of colours e.g. 360×360 dots per square inch and 16.7 million colours.

In a preferred embodiment four reservoirs are provided housed in a compartment within the casing, each containing a food colourant of a different colour. The food colourant can of course be black, white, or any other colour, in the preferred embodiment however the four reservoirs contain Yellow, Magenta, Cyan and Black respectively. Each reservoir supplies a separate and distinct printing head; by this means it is possible to print a multiplicity of colours which is not possible with machines having a common reservoir. In general the machine will also include associated elements such as a power supply, a control panel, logic board, and associated wiring. Any suitable means may be provided to operate the machine, e.g. a computer, keypad or pointing device. A movable surface is provided to move the edible medium, e.g. a tray, conveyor belt or rollers. In a preferred embodiment the surface for holding the edible substrate is movable longitudinally of the machine by means of a conveyor belt, chain drive, rollers or similar device and the bubble-jet head assembly is movable laterally of the machine some 2–10 mm above the edible substrate. By these means the bubble-jet head assembly at no time comes into contact with the edible surface, which also meazns that the machine and method of the present invention can print upon an edible substrate having depth variations of up to, say, 8 mm.

In a preferred embodiment the area of edible surface to be decorated can be from a small dot up to 297 mm×420 mm (A3) or any other such size as determined from time to time.

The machine of this invention may be used in conjunction with any suitable edible substrate, e.g. Royal icing, gum paste, sugar paste, fresh cream, cover paste, ice cream, butter cream, wafer, rice paper, gelatine, marzipan, fondant, american frosting, meringue, boiled icing, chocolate, boiled sugar, confectioners cream, custard, blancmange, cheesecake filling, pastry, pastilliage, nut paste, wafer, biscuit, cheese, potato, pasta, etc.

Referring to FIG. (2) there is shown a method by which small dots of different colourant may combine to give a plurality of different colours by the following method. The print head (1 FIG. 1) moves over the surface of the edible substrate (9 FIG. 1) and each head deposits flying droplets of colourant which are discharged towards the edible substrate according to the instructions received from the computer (12 FIG. 1). In the preferred embodiment the preferred colours are Yellow, Magenta, Cyan and Black which when combined on the edible substrate in varying proportions enable the production of polychromatic images to be produced and not just monochromatic images as would be produced by machines that have single heads.

FIG. (3) shows an example of the output of the machine in FIG. (1). It will be seen that it is an incredibly intricate picture or three Lions. This is a higher quality image than has previously been obtainable on an edible substrate.

The machine of this invention enables individual designs to be produced to the same or better standard than has hitherto been commercially feasible and at a traction of the labour and material cost.

The method and machine of the present invention can operate to apply polychromatic as well as monochromatic images effectively onto edible-substrates.

It will also be understood that the foregoing structure is capable of variation without departing from the spirit and scope of the present invention.

What is claimed is:

1. A machine adapted to print an image onto a surface of an edible substrate, the machine including a bubble-jet printer head assembly, and containment means for containing a liquid food colourant, a surface for supporting the said edible substrate, said surface and said head assembly being movable relative to each other, and control means for controlling said head assembly with printing instructions and for causing said relative movement in accordance with the desired image to be printed upon an edible substrate, and wherein said control means is adapted to control the use of copyright images within the system.

2. A machine according to claim 1 which is adapted to print a polychromatic image.

3. A machine according to claim 2 wherein said containment means comprises a plurality of reservoirs for a plurality of liquid food colourants.

4. A machine according to claim 1 wherein the bubble-jet head assembly is of the type comprising a discharging opening for liquid discharge and an electricity-heat converter, the electricity-heat converter having a region formed by oxidation of at least part of an electro-conductive material, and the region being adapted to generate heat.

5. A machine according to claim 1 wherein the edible substrate is movable longitudinally of the machine and the head is movable laterally of the machine.

6. A machine according to claim 1 wherein the edible substrate is movable laterally of the machine and the head is movable longitudinally of the machine.

7. A machine according to claim 1 which includes a computer system.

8. A machine according to claim 1 which is adapted to be operated from a keyboard, keypad or pointing device.

9. A machine according to claim 1 which is adapted to monitor for a copyright holder the number of times a copyright image is printed.

10. A machine according to claim 1 adapted to change the colour of any image or part thereof.

11. A machine according to claim 1 which includes a scanning device to enable scanning and printing of an image.

12. A machine adapted to print an image onto a surface of an edible substrate, the machine including a bubble-jet printer head assembly, and containment means for containing a liquid food colourant, a surface for supporting the said edible substrate, said surface and said head assembly being movable relative to each other, and control means for controlling the said head assembly with printing instructions and for causing said relative movement in accordance with the desired image to be printed upon an edible substrate, and wherein said control means is adapted to monitor for a copyright holder the number of times a copyright image is printed.

* * * * *